United States Patent [19]

Menjo et al.

[11] Patent Number: 4,477,561

[45] Date of Patent: Oct. 16, 1984

[54] SILVER HALIDE PHOTOGRAPHIC MATERIAL

[75] Inventors: Hiroshi Menjo, Hachioji; Yoshikazu Watanabe, Akishima; Nobuo Sakamoto, Isukui, all of Japan

[73] Assignee: Konishiroku Photo Industry Co., Ltd., Tokyo, Japan

[21] Appl. No.: 467,365

[22] Filed: Feb. 17, 1983

[30] Foreign Application Priority Data

Feb. 19, 1982 [JP] Japan ..... 57-26381

[51] Int. Cl.[3] ..... G03C 1/08

[52] U.S. Cl. ..... 430/509; 430/564; 430/604; 430/605

[58] Field of Search ..... 430/509, 564, 604, 605, 430/508

[56] References Cited

U.S. PATENT DOCUMENTS 2,448,060 8/1948 Smith et al. ..... 430/605

3,888,676 6/1975 Evans ..... 430/509

FOREIGN PATENT DOCUMENTS 774655 5/1957 United Kingdom ..... 430/509

*Primary Examiner*—Won H. Louie

*Attorney, Agent, or Firm*—Finnegan, Henderson, Farabow, Garrett & Dunner

[57] ABSTRACT

A silver halide photographic material having formed on a support two or more layers that are sensitive to the lights of substantially the same spectral region but different in light sensitivity is disclosed. At least one of the layers other than the one having maximum light sensitivity contains at least 40 mg, per 100 g of silver, of a water-soluble compound containing an element of Group VIII of the periodic table which has a molecular weight of 100 or more. The material has a wide latitude for exposure, and this latitude will not vary greatly with time during storage.

3 Claims, No Drawings

SILVER HALIDE PHOTOGRAPHIC MATERIAL

FIELD OF THE INVENTION

The present invention relates to a silver halide photographic material, and, more particularly, to a silver halide photographic material having a wide latitude for exposure.

BACKGROUND OF THE INVENTION

Silver halide photographic materials having a wide latitude for exposure (hereinafter referred to simply as photographic materials) are known and they are prepared by coating a support with silver halide emulsion layers of high sensitivity and silver halide emulsion layers of low sensitivity simultaneously. Two typical exmples of the photographic material of this type are described in British Pat. Nos. 774,655 and 1,021,564. These photographic materials may be effective for some specific purposes, but it sometimes occurs that a very bright image flares and cancels the darker image. To avoid this problem, a photographic material with a latitude wide enough to present high contrast with a dark image and low contrast with a light image is desired, and one example of such photographic material is disclosed in Japanese Patent Publication No. 3843/1974. But all of these conventional products often experience variations in latitude during storage. In particular, the color reproduction of multi-layered silver halide color photographic materials (hereinafter referred to simply as color photographic materials) varies with time. At present, no method is available that is effective in preventing this serious defect.

SUMMARY OF THE INVENTION

Therefore, one object of the present invention is to provide a new photographic material having a wide latitude for exposure.

Another object of the present invention is to provide a photographic material improved in the variation in latitude during storage.

These objects can be achieved by a photographic material or color photographic material having formed on a support two or more layers that are sensitive to the lights of substantially the same spectral region but different in light sensitivity, wherein at least one of the layers other than the one having maximum sensitivity contains at least 40 mg, per 100 g of silver, of a water-soluble compound containing an element of Group VIII of the periodic table which has a molecular weight of 100 or more.

DETAILED DESCRIPTION OF THE INVENTION

The preferred examples of the water-soluble compound composed of an element of Group VIII of the periodic table which has a molecular weight of 100 or more are salts of metals of Group VIII5 and VIII6 of the periodic table such as ruthenium, rhodium, palladium, osmium, iridium and platinum. Typical compounds include:

(1) ammonium chloropalladate;
(2) potassium chloroplatinate;
(3) sodium chloroplatinate;
(4) ammonium chloroplatinate;
(5) sodium chloropalladite;
(6) ammonium hexachloroiridate (IV);

(7) potassium hexachloroiridate (IV);
(8) sodium hexachloroiridate (IV);
(9) ammonium hexachloroosmate (IV);
(10) rhodium trichloride;
(11) potassium hexachlororhodate;
(12) sodium hexachlororhodate;
(13) diaminopalladium chloride; and
(14) sodium hexachloroplatinate (IV).

Rhodium, iridium and platinum salts are more preferred. The above listed compounds are effectively contained in the photographic material each in an amount of 40 mg or more per 100 g of silver, and more preferably, they are contained each in an amount ranging from 40 mg to 500 mg.

The metal compound according to the present invention is preferably dissolved in water for incorporation in a photographic emulsion. The effective range of the concentration of the aqueous solution is from 0.01 wt % to 10 wt %. The metal compound may be added to the photograhic emulsion at the time of or before or after chemical ripening, or at the time of preparation of silver halide grains. Preferably, the compound is added after chemical ripening.

In the present invention, the lights of substantially the same spectral region means the lights which have the same energy distribution.

The optimum difference in the sensitivty between the layer having maximum sensitivity and the other layers incorporated in the photographic material of the present invention may be determined by a known method in consideration of gradation, and generally the difference ranging from 0.05 to 1.5 logE (E for exposure) is preferred.

The photographic material of the present invention may be used in color photography or black-and-white photography. If it is used for color photography, one or more of the watersoluble compounds composed of an element of Group VIII of the periodic table are incorporated in at least one layer that is selected from among a blue-sensitive silver halide emulsion layer, a green-sensitive silver halide emulsion layer and a red-sensitive silver halide emulsion layer and which is other than the layer having the highest sensitivity of the layers that are sensitive to the same color but different in light sensitivity. The layer having maximum sensitivity may contain the water-soluble compound in an amount that does not exceed 40 mg per 100 g of silver. The photographic material of the present invention preferably comprises two to four layers that are sensitive to the same color but different in light sensitivity, and a non-sensitive layer (intermediate layer) may be disposed between such sensitive layers.

The silver halide emulsion for use in the photographic material of the present invention may be any of the silver halide emulsions that are conventionally used in the art, containing silver chloride, silver bromide, silver iodobromide, silver chlorobromide, silver chloroiodine and chloroiodobromide crystals, as well as mixtures thereof. The silver halide emulsion may be made of large or small grains, and it may be of a mono- or polydispersed system. The silver halide crystals may be cubic, octahedral or mixed epitaxial crystals or the like. The emulsion may be of negative type or direct positive type. It is a surface latent image type emulsion wherein a latent image is formed primarily on the surface of silver halide grains, or an internal latent image type emulsion wherein the latent image is primarily formed in the interior of the silver halide grains, or it may be a mixture of the two types.

The photographic material of the present invention may contain a light-sensitive dye for purposes such as spectral sensitization, and any dye can be used depending on the specific object. For example, the material may contain cyanine dyes, merocyanine dyes and xanthene dyes of the types listed in C.E.K. Mees and T.H. James, "The Theory of the Photographic Process", 3rd. ed., McMillan Co., N.Y., 1966, pp. 198–228.

The photographic material of the present invention may contain a binder such as gelatin, colloidal albumin, agar, gum arabic, and alginic acid; cellulose derivatives, e.g. hydrolyzed cellulose acetate carboxymethyl cellulose, hydroxyethyl cellulose and methyl cellulose; synthetic binders, e.g. polyvinyl alcohol, partially saponified polyvinyl acetate, polyacrylamide, poly-N,N-dimethylacrylamide, poly-N-vinylpyrrolidone, and water-soluble polymers; gelatin derivatives, e.g. phenylcarbamylated gelatin, acylated gelatin and phthalated gelatin; and gelatin graft copolymers wherein polymerizable, ethylene-containing monomers such as acrylic acid (esters methacrylic acid (esters) and acrylonitrile are grafted to gelatin. These binders may optionally be used as two or more compatible mixtures.

The silver halide emulsion used in the photographic material of the present invention may be sensitized with a chemical sensitizer such as a noble metal sensitizer, sulfur sensitizer, selenium sensitizer or reduction sensitizer, and good results are obtained if these sensitizers are used in combination.

The silver halide emulsion used in the present invention may also contain a stabilizer. Examples of the stabilizer that can be used with advantage in the present invention are listed below: (1) nitrogen-containing heterocyclic compounds such as 4-oxo-6-thiono-4,5,6,7-tetrahydro-1-thia-3,5,7-triazaindene, 2-substituted benzimidazole, benzotriazole, substituted 1,2,3-triazole, urazol, pyrazole tetrazole compounds, and polyvinyl pyrrolidone, the last-mentioned being particularly preferred; (2) quaternary ammonium salts such as thiazolinium compounds and pyrylium compounds, of which benzothiazolium compounds are particularly preferred; (3) mercapto compounds such as 5-phenyl-1-mercaptotetrazole, 2-mercapto-benzothiazole, 2-mercaptothiazole, mercaptobenzimidazole, mercaptoxadiazole, mercaptothiadiazole, thiosugar and 4-thiouracil, of which 5-phenyl-1-mercaptotetrazole and 2-mercaptobenzothiazole are particularly preferred; (4) polyhydroxybenzene compounds such as 1,2-dihydroxybenzene compounds, gallic acid esters (e.g. isoamyl gallate, dodecyl gallate and propyl gallate) and 2-alkyl-hydroquinone; (5) thione compounds such as thiazoline-2-thione compounds, their zinc and cadmium salts being also preferred; (6) tetrazaindene compounds such as 4-hydroxy-6-methyl-1,3,3a,7-tetrazaindene, 4-methyl-6-hydroxy-1,3,3a,7-tetrazaindene, and 4-hydroxy-5,6-dimethyl-1,3,3a,7-tetrazaindene. These stabilizers achieve better results when they are used in combination.

The emulsion is hardened by the conventional method. Suitable hardeners are selected from among conventional photographic hardeners and they include aldehyde compounds such as formaldehyde, glyoxal and glutaraldehyde, as well as their derivatives such as acetal and sodium bisulfite adducts; methanesulfonic acid ester compounds; mucochloric acid and mucohalogenic acid compounds; epoxy compounds; aziridine compounds; active halogen compounds; maleic acid imide compounds; active vinyl compounds; carbodiimide compounds; isoxazole compounds; N-methylol compounds; isocyanate compounds; inorganic hardeners such as chrome alum and zirconium sulfate.

The photographic material of the present invention may contain a surfactant either alone or in combination. It may also contain an antistat, a plasticizer, a brightening agent, a development accelerator, an aerial fog inhibitor or a tone modifier.

The photographic material of the present invention may contain any of the known dye-forming couplers to produce color images. In most cases, it is preferred that the coupler remain in the layer where it is incorporated and do not diffuse to other layers during the production, storage and processing of the photographic material. The coupler may be four-equivalent or two-equivalent. For color correction, the photographic material may even contain a colored coupler, a colorless coupler or a DIR coupler that releases a development inhibitor during development.

Known open-ring ketomethylene couplers may be used as yellow couplers, and benzoyl acetanilide and pivaloyl acetanilide compounds are used with advantage. Suitable yellow couplers are listed in U.S. Pat. Nos. 2,875,057, 3,408,194, 3,551,155, 3,582,322 and 3,894,875. German Patent Publication No. 1,547,868, and German patent applications (OLS) Nos. 2,213,461, 2,261,361, 2,263,875 and 2,414,006. As magenta couplers, 5-pyrazolone compounds are primarily used, and indazolone and cyanoacetyl compounds may also be used. Suitable magenta couplers are mentioned in U.S. Pat. Nos. 2,600,788, 3,062,653, 3,127,269, 3,311,476, 3,419,391, 3,519,429, 3,558,319, 3,582,322 and 3,615,506, German Pat. No. 1,810,464, German patent applications (OLS) Nos. 2,408,665, 2,418,959 and 2,424,467, and Japanese Patent Publications Nos. 6031/1965 and 2016/1969. As cyan couplers, phenol and naphthol derivatives are primarily used, and their specific examples are given in U.S. Pat. Nos. 2,369,929, 2,474,293, 2,521,908, 2,895,826, 3,034,892, 3,386,830, 3,458,315, 3,476,563, 3,583,971 and 3,591,383, and Japanese patent application (OPI) No. 78905/1973 ( the symbol OPI as used herein means an unexamined published Japanese patent application).

The photographic material of the present invention may further contain a DIR coupler or a compound that releases a development inhibiting compound during color forming reaction. Examples of such compounds are described in U.S. Pat. Nos. 3,227,554, 3,632,345, 3,701,783 and 3,790,384, British Pat. No. 953,454, German patent applications (OLS) Nos. 2,414,006, 2,417,914, 2,454,301 and 2,454,329, U.S. Pat. Nos. 3,297,445 and 3,379,529, and Japanese patent applications (OPI) Nos. 145135/ 1979 and 137353/1981.

The photographic material of the present invention may also contain a colored coupler for color correction purposes. To provide the characteristics necessary for photographic materials, two or more of the couplers listed above may be incorporated in the same layer, or alternatively, the same compound may be added to two or more different layers. Usually, these couplers are dispersed in a silver halide photographic emulsion layer together with a solvent having a suitable polarity. Useful solvents are tri-o-cresyl phosphate, trihexyl phosphate, dioctylbutyl phosphate, di-butylphthalate, diethyl laurylamide, 2,4-diallylphenol and octyl benzoate. It is to be understood that the photographic material of the present invention may contain photographic adenda other than those mentioned above.

The concept of the present invention is applicable to various photographic materials such as color and black-and-white positive films, color and black-and-white papers, color and black-and-white negative films, color and black-and-white reversal films which may contain couplers, photographic materials for lithography (e.g. films for photogravure), photographic materials for CRT display, photographic materials for radiographic recording, and photographic materials for heat development (as described in U.S. Pat. Nos. 3,152,904, 3,312,550 and 3,148,122 and British Pat. No. 1,110,046). The present invention is also applicable to various photographic processes such as colloid transfer process (as described in U.S. Pat. No. 2,716,059), silver salt diffusion transfer process (as described in U.S. Pat. Nos. 2,352,014, 2,543,181, 3,020,155 and 2,861,885), color diffusion transfer process (as described in U.S. Pat. Nos. 3,087,817, 3,185,567, 2,983,606, 3,253,915, 3,227,550, 3,227,551, 3,227,552, 3,415,644, 3,415,645 and 3,415,646), dye transfer process (such as described in U.S. Pat. No. 2,882,156), and silver dye bleach process (as described in Freedman, "History of Color Photography", American Photographic Publishers Co., 1944, Ch. 24, and British Journal of Photography, Vol. 111, pp. 308–309, Apr. 7, 1964).

The present invention is now described in greater detail by reference to the following examples which are given here for illustrative purposes only and are by no means intended to limit the scope of the invention.

EXAMPLE 1

Eight samples were prepared by coating a triacetate base with first and second layers having the formulations indicated below:

First layer

A panchromatic low-sensitive silver iodobromide emulsion containing 4 mol % of silver iodide and having an average grain size of 0.7 micron was prepared by the double jet method and subjected to gold and sulfur sensitization. The sensitized emulsion was divided into 9 portions. Aqueous solutions of the compounds listed in Table 1 below were added to 1 kg of the emulsion (containing 1 mol of silver halide) in the amounts indicated in Table 1. The resulting 9 emulsion samples were mixed with mucochloric acid and saponin and applied to the triacetate base in a dry thickness of 2.0 microns.

Second layer

A panchromatic high-sensitive silver iodobromide emulsion containing 7 mol % of silver iodide and having an average grain size of 1.2 microns was prepared by the double jet method and subjected to gold and sulfur sensitization. The sensitized emulsion was divided into 9 portions, which were blended with mucochloric acid and saponin and applied to the first coating of the respective samples in a dry thickness of 2.0 microns. Two strips were made of each sample of photographic material, and one of them was incubated (stored)in a container (65° C. and 50% rh) for 7 days and the other was used as a control without such incubation treatment. The two strips were subjected to wedge exposure with a sensitometer Model KS-1 (product of Konishiroku Photo Industry Co., Ltd.), developed with a developing solution of the formulation indicated below at 30° C. for 2 minutes, fixed and washed with water.

| Formulation of the developer | |
|---|---|
| p-Methylaminophenol sulfate | 3 g |
| Anhydrous sodium sulfite | 50 g |
| Hydroquinone | 6 g |
| Sodium carbonate | 29.5 g |
| Potassium bromide | 1 g |
| Water to make | 1000 ml |

For each of the silver images produced, a characteristic curve was plotted with an automatic densitometer (product of Konishiroku Photo Industry Co., Ltd.) to obtain data on fog and latitude for exposure. The results are also shown in Table 1.

TABLE 1

| Sample No. | Compound*1 | Amount added (mg per 100 g of silver) | Control (immediately processed) Fog | Control Latitude | Incubated Fog | Incubated Latitude | Remarks |
|---|---|---|---|---|---|---|---|
| 1 | — | — | 0.05 | 100 | 0.09 | 94 | Comparative |
| 2 | (1) | 50 | 0.04 | 122 | 0.04 | 121 | Present invention |
| 3 | (4) | 30 | 0.04 | 117 | 0.08 | 117 | Comparative |
| 4 | " | 40 | 0.04 | 120 | 0.05 | 120 | Present invention |
| 5 | " | 50 | 0.04 | 120 | 0.04 | 120 | " |
| 6 | " | 100 | 0.04 | 120 | 0.04 | 121 | " |
| 7 | (6) | 50 | 0.04 | 124 | 0.04 | 123 | " |
| 8 | (9) | 50 | 0.04 | 123 | 0.04 | 123 | " |
| 9 | (11) | 50 | 0.04 | 124 | 0.04 | 123 | " |

The values of latitude are represented by logE in the linear portion of the characteristic curves of the respective samples, with control sample No. 1 taken as a reference (100).

*1The compounds are indicated by the numbers used in the list of compounds given in the specification.

EXAMPLE 2

Fifteen samples were prepared by coating a triacetate base with first and second layers having the formulations indicated below:

First layer

A red-sensitive, low-sensitivity silver iodobromide emulsion containing 4 mol % of silver iodide and having an average grain size of 0.7 micron was prepared by the double jet method and subjected to gold and sulfur sensitization. The sensitized emulsion was divided into 16 portions. Aqueous solutions of the compounds listed in Table 2 below were added to 1 kg of the emulsion (containing 1 mol of silver halide) in the amounts indicated in Table 2. A cyan coupler (25 g) which was 1-hydroxy-N -[δ-(2,4-di-t-amylphenoxy)butyl]-2-naphthamide and a colored cyan coupler (2 g) which was a disodium salt of 1-hydroxy-4-[4-(1-hydroxy-8-acetamido-3,6-disulfo-2-naphthylazo)-phenoxy]-N -[δ-(2,4-di-t-amylphenoxy)butyl]-2-naphthamide were dissolved in a mixture of tricresyl phosphate (28 g) and ethyl acetate (55 ml) under heating. The solution was added to 200 ml of 7.5% aqueous gelatin containing 2 g of sodium triisopropyl naphthalenesulfonate, and the mixture was emulsified with a chlloid mill. The resulting emulsion was added to 1 kg of each of the previously prepared 16 red-sensitive, low-sensitivity silver iodobromide emulsions, and the individual mixtures were blended with mucochloric acid and saponin and coated onto the triacetic base in a dry thickness of 2.0 microns.

Second layer

A red-sensitive, low-sensitivity silver iodobromide emulsion containing 7 mol % of silver iodide and having an average grain size of 1.2 microns was prepared by the double jet method and subjected to gold and sulfur sensitization. The sensitized emulsion was divided into 16 portions. Aqueous solutions of the compounds listed in Table 2 were added to 1 kg of the emulsion (containing 1 mol of silver halide) in the amounts indicated in Table 2. A cyan coupler (5 g) which was 1-hydroxy-4-[β-methoxyethylaminocarbonylmethoxy]-N-[δ-(2,4-di-t-amylphenoxy)butyl ]-2-naphthamide and a colored coupler (0.2 g) which was the same as used in the first layer were dissolved in a mixture of tricresyl phosphate (10 g) and ethyl acetate (25 ml) under heating. The solution was added to 200 ml of 7.5% aqueous gelatin containing 1g of sodium triisopropylnaphthalenesulfonate, and the mixture was emulsified with a colloid mill. The resulting emulsion was added to 1 kg of each of the previously prepared 16 red-sensitive, low-sensitivity silver iodobromide emulsions, and the individual mixtures were applied to the first coating of the respective samples in a dry thickness of 2.0 microns. Two strips were made of each sample of photographic material, and one of them was incubated as in Example 1, and the other was used as a control. The two strips were subjected to wedge exposure with a sensitometer Model KS-1 (product of Konishiroku Photo Industry Co., Ltd.), developed with a color developer of the formulation indicated below at 38° C. for 3 minutes, bleached, fixed and washed with water.

| Formulation of the color developer | |
|---|---|
| 4-amino-3-methyl-N—ethyl-N—(β-hydroxyethyl)-aniline sulfate | 4.75 g |
| Anhydrous sodium sulfite | 4.25 g |
| Hydroxylamine hemisulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water to make | 1000 ml |
| (pH adjusted to 10.0 with potassium hydroxide) | |

The results are shown in Table 2, Samples Nos. 24 and 25 contained none of the compounds according to the present invention; Sample No. 24 contained only comparative compound A (hexaminecobalt trichloride) and Sample No. 25 contained only comparative compound B (hexamminecadmium dichloride).

TABLE 2

| Sample No. | Metal Compound 1st Layer Compound*2 | Amount added | 2nd Layer Compound*2 | Amount added | Control (immediately processed) Fog | Latitude | Incubated Fog | Latitude | Remarks |
|---|---|---|---|---|---|---|---|---|---|
| 10 | — | — | — | — | 0.06 | 100 | 0.10 | 86 | Comparative |
| 11 | (1) | 50 | — | — | 0.05 | 120 | 0.06 | 122 | Present invention |
| 12 | (4) | 50 | — | — | 0.04 | 123 | 0.04 | 124 | " |
| 13 | (6) | 30 | — | — | 0.05 | 119 | 0.09 | 115 | Comparative |
| 14 | " | 40 | — | — | 0.04 | 122 | 0.05 | 121 | Present invention |
| 15 | " | 50 | — | — | 0.04 | 122 | 0.04 | 121 | Present invention |
| 16 | " | 100 | — | — | 0.04 | 122 | 0.04 | 122 | " |
| 17 | (9) | 50 | — | — | 0.05 | 125 | 0.06 | 121 | " |
| 18 | (11) | 50 | — | — | 0.04 | 123 | 0.04 | 124 | " |
| 19 | — | — | (6) | 30 | 0.05 | 98 | 0.10 | 95 | Comparative |
| 20 | — | — | " | 50 | 0.05 | 97 | 0.09 | 95 | " |
| 21 | (4) | 50 | (4) | 50 | 0.04 | 121 | 0.04 | 109 | " |
| 22 | (4) | 50 | (4) | 30 | 0.04 | 133 | 0.04 | 131 | Present invention |
| 23 | (11) | 50 | (11) | 30 | 0.04 | 127 | 0.04 | 126 | " |
| 24 | A | 50 | — | — | 0.06 | 93 | 0.12 | 82 | Comparative |
| 25 | B | 50 | — | — | 0.06 | 91 | 0.11 | 97 | " |

Amount added: mg/100 g of silver
*2The compounds are indicated by the number used in the list of compounds given in the specification, as well as by A and B.

EXAMPLE 3

Samples Nos. 26 to 35 were prepared as in Example 2 except that the compounds indicated in Table 3 were used. Furthermore, the red-sensitive emulsion was replaced by a green-sensitive emulsion, and the cyan coupler by a magenta coupler which was 1-(2,4,6-trichlorophenyl)-3-[3-(2,4-di-t-amylphenoxyacetamido) benzamide]-5-pyrazolone. The samples were processed as in Example 2, and the results are shown in Table 3.

TABLE 3

| Sample No. | Metal Compounds 1st Layer Compound*3 | Amount added | 2nd Layer Compound*3 | Amount added | Control (Immediately processed) Fog | Latitude | incubated Fog | Latitude | Remarks |
|---|---|---|---|---|---|---|---|---|---|
| 26 | — | — | — | — | 0.07 | 100 | 0.14 | 92 | Comparative |
| 27 | (4) | 100 | — | — | 0.05 | 119 | 0.05 | 119 | Present invention |
| 28 | (6) | 30 | — | — | 0.07 | 120 | 0.12 | 118 | Comparative |
| 29 | " | 50 | — | — | 0.05 | 120 | 0.05 | 120 | Present invention |
| 30 | " | 100 | — | — | 0.04 | 120 | 0.04 | 121 | Present |

TABLE 3-continued

| Sample No. | Metal Compounds 1st Layer Compound*3 | Amount added | 2nd Layer Compound*3 | Amount added | Control (Immediately processed) Fog | Latitude | incubated Fog | Latitude | Remarks |
|---|---|---|---|---|---|---|---|---|---|
| 31 | (11) | 100 | — | — | 0.04 | 123 | 0.04 | 123 | invention Present |
| 32 | — | — | (6) | 30 | 0.06 | 115 | 0.11 | 107 | invention Comparative |
| 33 | (4) | 100 | (6) | 30 | 0.05 | 127 | 0.05 | 127 | Present invention |
| 34 | A | 100 | — | — | 0.07 | 91 | 0.12 | 88 | Comparative |
| 35 | B | 100 | — | — | 0.07 | 89 | 0.13 | 95 | " |

Amount added: mg/100 g of silver
*3The compounds are indicated by the numbers used in the list of compounds given in the specification.

As is clear from Tables 1 to 3, the compounds of the present invention were little effective when they were incorporated in a layer that was sensitive to the same color but higher in light sensitivity than the other layer. But when the compounds were contained in the other layer (of the lower sensitivity) in the amounts specified hereinabove, photographic materials having a wide latitude were obtained and their photographic characteristics changed little with time during storage. The same results as in Example 2 were obtained when the red-sensitive emulsion was replaced by a blue-sensitive emulsion, and the cyan coupler by a yellow coupler which was α-pivaloyl-5-[Y-(2,4-di-t-amylphenoxy)-butylamido]-2-chloroacetanilide.

What is claimed is:

1. A silver halide photographic material having a wide latitude for exposure which will not vary greatly with time during storage, said material having formed on a support two or more layers that are sensitive to the lights of substantially the same spectral region but different in light sensitivity, wherein at least one of the layers other than the layer having maximum light sensitivity contains at least 40 mg, per 100 g of silver, of a water-soluble compound containing an element of Group VIII of the periodic table which has a molecular weight of 100 or more and the layer having maximum light sensitivity contains a water-soluble compound containing an element of Group VIII of the periodic table with a molecular weight of 100 or more in an amount that does not exceed 40 mg per 100 g of silver.

2. A silver halide photographic material according to claim 1, wherein said water-soluble compound is a salt of a metal of Group VIII 5 or VIII 6 of the periodic table.

3. A silver halide photographic material according to claim 1, wherein at least one of the layers other than the one having maximum light sensitivy contains said water-soluble compound in an amount ranging from 40 mg to 500 mg per 100 g of silver.

* * * * *